United States Patent [19]

Fredley

[11] Patent Number: 4,494,267

[45] Date of Patent: Jan. 22, 1985

[54] BRUSH CLEANER AND ARTIST'S KIT

[76] Inventor: C. Thomas Fredley, 1119 N. 46th St., Phoenix, Ariz. 85008

[21] Appl. No.: 440,002

[22] Filed: Nov. 8, 1982

[51] Int. Cl.[3] ..... A46B 17/06

[52] U.S. Cl. ..... 15/104.92; 15/1; 15/257 R

[58] Field of Search ..... 15/1, 104.92, 257 R, 15/264, 257.05, 260; 206/209, 1.7, 1.8; 220/90

[56] References Cited

U.S. PATENT DOCUMENTS

| | | | |
|---|---|---|---|
| 323,420 | 8/1885 | Hills | 206/209 X |
| 1,285,948 | 11/1918 | Cook | 15/1 |
| 1,553,023 | 9/1925 | Bonnell | 15/260 X |
| 2,255,091 | 9/1941 | Vaughn | 15/260 |
| 2,787,015 | 4/1957 | Flam | 15/260 |
| 2,841,808 | 7/1958 | Beyland | 15/260 X |
| 2,939,162 | 6/1960 | Kravitt | 15/257.05 |
| 2,941,692 | 6/1960 | Kappel | 220/90 |
| 2,963,727 | 12/1960 | Roberts | 15/104.92 |
| 3,191,799 | 6/1965 | Figge | 220/90 |
| 3,389,945 | 6/1968 | Thomas | 206/1.7 |
| 4,020,523 | 5/1977 | Brown | 15/257.05 |

FOREIGN PATENT DOCUMENTS

| | | | |
|---|---|---|---|
| 3007252 | 9/1981 | Fed. Rep. of Germany | 206/209 |

*Primary Examiner*—Edward L. Roberts
*Attorney, Agent, or Firm*—James F. Duffy

[57] ABSTRACT

Fluid is inertially removed from the bristles of brush by causing the bristles of a moving brush to be intercepted in the path of their motion in a manner so as to abruptly affect the speed of movement of the bristles and so inertially disperse fluid therefrom. The fluid so dispersed is collected within an opened top container comprising an upright walled enclosure. This upright walled enclosure may be utilized in the manner disclosed for stowing and transporting additional items useful to an artist.

5 Claims, 11 Drawing Figures

FIG. 1
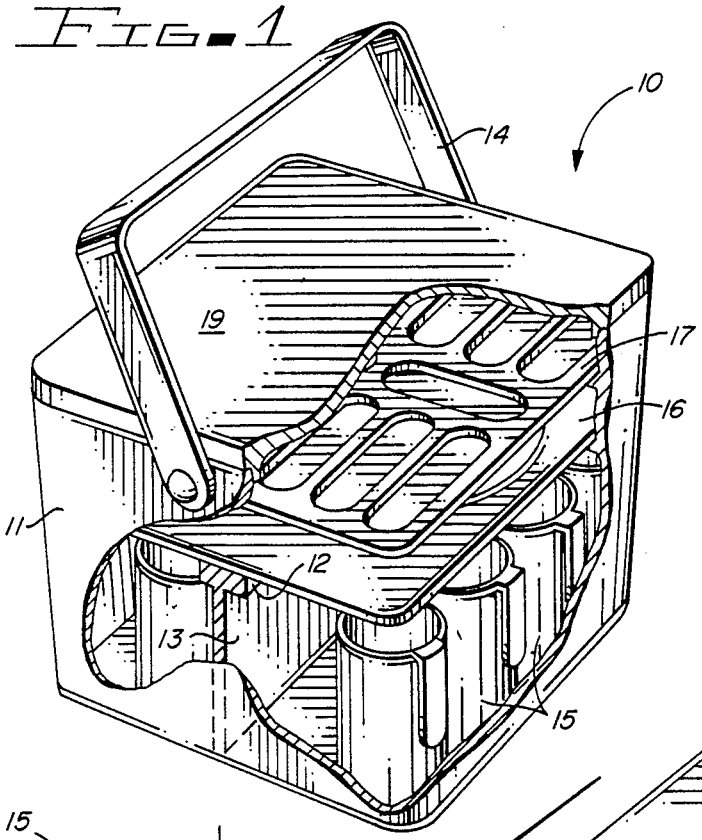
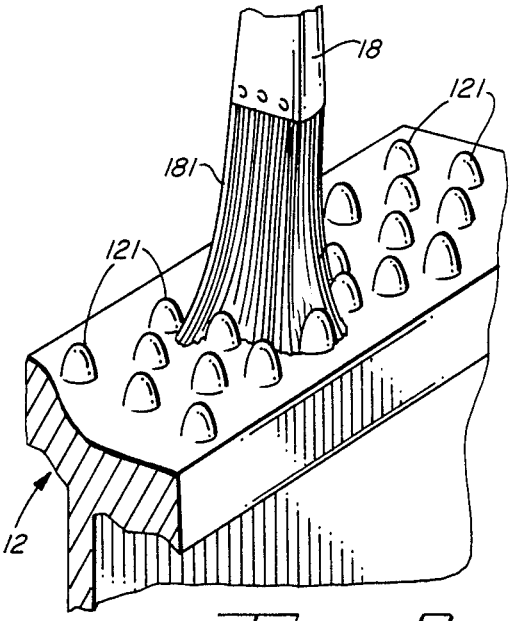
FIG. 8
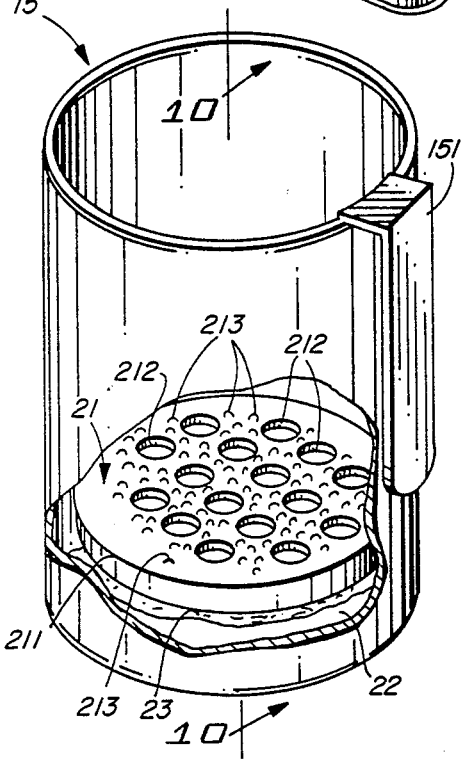
FIG. 9
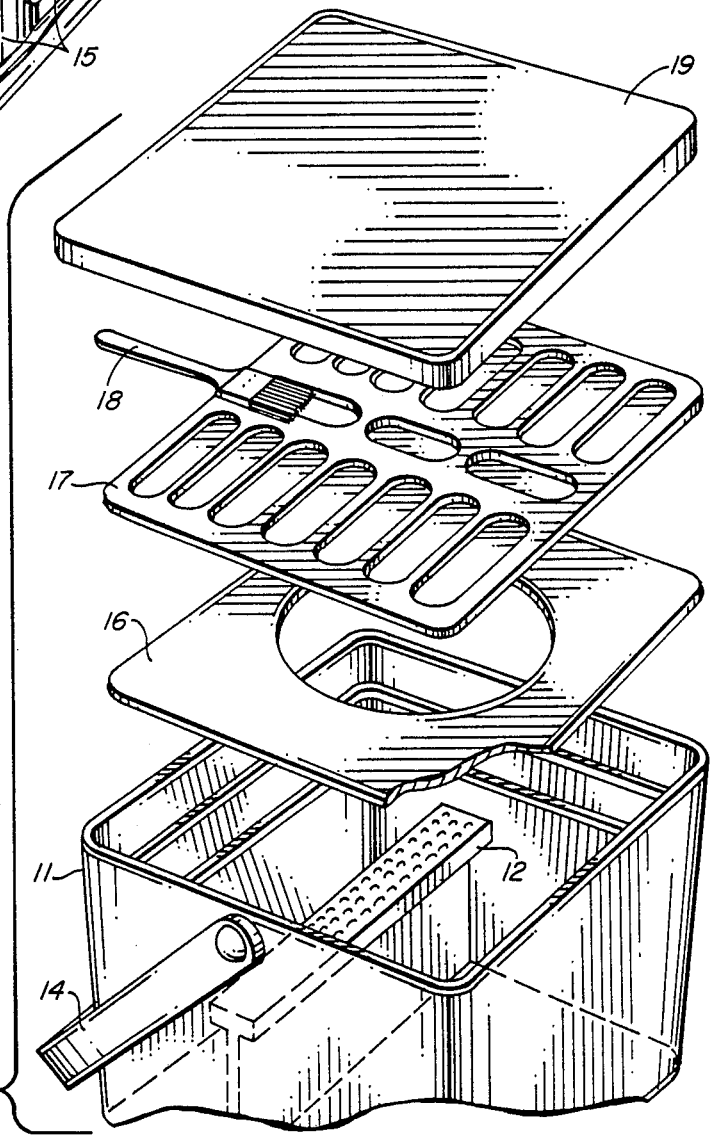
FIG. 2

BRUSH CLEANER AND ARTIST'S KIT

BACKGROUND

1. Field of the Invention

The invention relates to methods and apparatus for cleaning paintbrushes.

The invention particularly relates to apparatus and methods for cleaning artist's paintbrushes being used by an artist in the course of pursuing his artistic activities.

The invention specifically relates to the inertial removing of color and fluid from the bristles of a paintbrush by abruptly changing the speed of motion imparted to the bristles of the brush.

2. Prior Art

When an artist is working with colors, whether the colors be oil, acrylic, or watercolor, he must frequently clean his brush to remove the color material therefrom so that he may begin work with a new color. Typically, this is accomplished by immersing the brush in a first liquid thinning material such as water or turpentine, then removing the liquid which remains in the brush by wiping it on a cloth or a blotting paper or by scrapping the brush across one or more scraper bars such as those disclosed in U.S. Pat. No. 2,963,727 (A. J. Roberts, inventor). The brush is then again immersed in a relatively clean thinning solution and again the liquid retained on the brush is removed by wiping the brush on a rag or a blotting paper or by scraping the brush across one or more scraper bars.

When artists are working in the open or in an area where the condition of the floor is of little consequence, the artist will frequently remove the excess fluid from the bristles of the brush by swinging the brush in a rapid movement and then abrupting stopping that movement so that the inertia of the fluid particles causes the fluid to continue in motion and depart from the bristles onto the ground or the floor at the site at which the artist is working.

The first method wherein the liquid is removed from the bristles of the brushes by wiping the brushes on a rag or blotting paper or by scraping the brushes across one or more scraper bars is time consuming and the latter method of inertially removing fluid from the bristles of the brush constitutes at best pollution of the immediate environment in which the artist is working. The inertial removal of fluid from the brush bristles, however, is significantly faster than the wash, wipe, and dry or wash and scrape methods.

It is therefore an objective of the invention to provide the means and method for inertially removing the fluid contained in the bristles of a brush by effecting a series of abrupt reversals of inertial forces upon the bristles of such a brush.

It is a further objective of the invention to provide for the inertial removal of fluid from the bristles of a brush without contaminating the working environment.

It is another object of the invention to obviate the need for multiple washings of the brush prior to the brush being used with a new color.

A further objective of the invention is the provision of apparatus for thoroughly washing the brush and inertially removing the liquid which remains in the brush after such washing by inertial means.

It is a further objective of the invention to provide means for washing a brush and inertially removing the fluid therefrom including associated cooperative means comprising an artist's kit comprised of artist's materials suitable for use in the field wherein this artist kit is readily transportable within the means for inertially removing liquid from the bristles of the brush.

SUMMARY OF THE INVENTION

The invention teaches means and method for cleaning the bristles of a brush. The brush cleaning apparatus comprises means for inertially removing fluid from the bristles of a brush and collection means coupled thereto for collecting fluid so removed from such bristles.

The means for inertially removing the fluid from the bristles of a brush comprise means for intercepting the path of the bristles of a moving brush so as to abruptly change in alternate direction the speed of movement of the bristles of a moving brush so as to inertially disperse fluid therefrom.

In the embodiment of the invention disclosed, the collection means for collecting fluid dispersed from the brush comprises an opened top container which itself is comprised of an upright walled enclosure. The means for intercepting the bristles of a moving brush then comprises a splatter bar which is coupled across the upright walled enclosure between brush acceleration and deceleration spaces.

In an embodiment of the invention herein disclosed and presently preferred, a splatter shield is interposed between the opened top of the container and the splatter bar means.

The bristles of a brush are washed before they are moved for interception by the splatter bar means. To this end, a liquid thinner containing vessel is used in cooperation with the brush cleaning apparatus. Within the liquid thinner containing vessel, float means are provided for floating on the liquid thinner container within the vessel. The float means is disposed so as to sink within the liquid thinner when the bristles of a brush are drawn into contact with the float means.

The surface of the float means contains a plurality of orifices through which the liquid thinner may flow as the float means is submerged when a brush is brought into contact with the surface. The liquid thinner, of course, flows back through these orifices as the float rises again to the surface of the liquid thinner when the bristles of the brush are removed from contact with the float means. In an embodiment disclosed, the surface of the float means is also provided with a plurality of raised elements or nubbins for separating the bristles of the brush when brought into contact with the float means.

As disclosed herein, the brush cleaning apparatus may serve to transport an artist's kit comprised of various materials suitable for use by an artist working in the field. The invention therefore further comprises container means which are removably stowable for transport within the collection means as well as a removable tray also stowable for transport. A cover to close the opened top container while the artist kit and cleaning apparatus are being transported is also disclosed and claimed herein.

DESCRIPTION OF THE DRAWINGS

FIG. 1 illustrates in perspective view a cross-section of the assembled brush cleaning apparatus and the elements comprising the artist kit.

FIG. 2 is an exploded view of the assembly of FIG. 1.

FIG. 8 illustrates the manner in which the provision of raised elements at the top of the splatter bar may be utilized for separating the bristles of the brush.

FIG. 9 illustrates a container of the type which may be utilized as part of the artist kit elements transportable within the brush cleaning apparatus and in particular illustrates the container provided with a float means suitable as an aid for washing brushes in liquid thinner emplaced within the container.

DETAILED DESCRIPTION OF THE INVENTION

Figure 3:
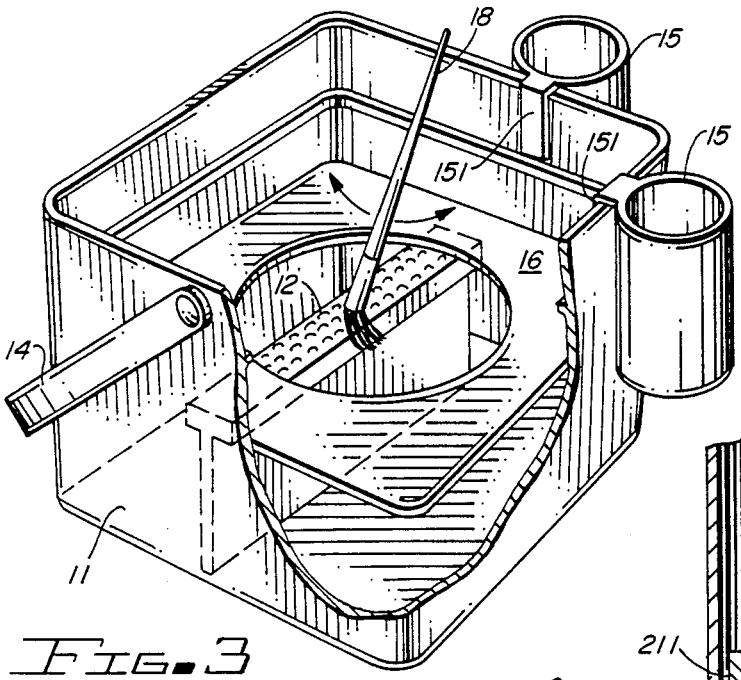
FIG. 3 is a perspective drawing of the brush cleaning apparatus with splatter shield in place and containers for colors and thinners handily attached for convenient access.

For purposes of promoting an understanding of the principles of the invention, reference will now be made to the embodiments illustrated in the drawings. Specific language will be used to describe the same. It will, nevertheless, be understood that no limitation of the scope of the invention is thereby intended, such alterations and further modifications in the illustrated device; and such further applications of the principles of the invention as illustrated herein being contemplated as would normally occur to one skilled in the art to which the invention relates.

FIG. 1 is a partially cutaway perspective view of the assembled brush cleaner and artist's kit 10. FIG. 2 is an exploded perspective view of the assembly 10. The brush cleaning apparatus is comprised of a splatter container 11 which is an opened top container defining an enclosure surrounded by upright walls. A splatter bar 12 is coupled across the enclosure defined by the walls of container 11, and is separated by spaces on both sides of splatter bar 12 from parallel walls of container 11. Splatter bar 12 provides the means for inertially removing fluid from the bristles of a brush and container 11 provides the means for collecting fluid removed from the bristles of that brush. The manner in which brushes are so cleaned will be disclosed fully hereinafter.

As a convenience to the artist who will utilize the brush cleaning apparatus, additional elements convenient for an artist to take into the field when on a painting expedition are also provided for stowable transport within container 11. These include fluid containers 15 which may be used for transporting liquid paints, thinners, and the like; a tray 17 for the transport of tubes of paint and upon which paintbrushes 18 may be laid for transport; and a cover 19 to cover splatter container 11 while the assembly 10 is being transported. Cover 19 may also serve as a palette for use by the artist on a field expedition. A handle 14 is provide for convenient handling of the assembly 10.

A splatter shield 16, which is interposed between the opened top of splatter container 11 and splatter bar 12, is provided to retain fluid splatter from the bristles of the brush within splatter container 11.

The manner in which in the brush cleaning apparatus is used is illustrated in the cutaway perspective drawing of FIG. 3. Here, containers 15 are coupled to splatter container 11 by means of hook handles 151. One or more containers 15 may be employed for carrying colors or thinning fluids. A brush 18, to be cleaned, is washed first in a thinning fluid within one of containers 15 and then moved rapidly within the opening provided within splatter shield 16 from the space on a first side of splatter bar 12 to the space on a second side of splatter bar 12, so as to cause splatter bar 12 to intercept the path of motion of the bristles of brush 18. When the bristles are so intercepted, the speed of motion of the bristles is abruptly changed causing fluid particles to be dispersed from the bristles owing to the inertia of the fluid particles. The action is demonstrated in the cross-sectional illustrations of FIGS. 4–7.

Figure 4:
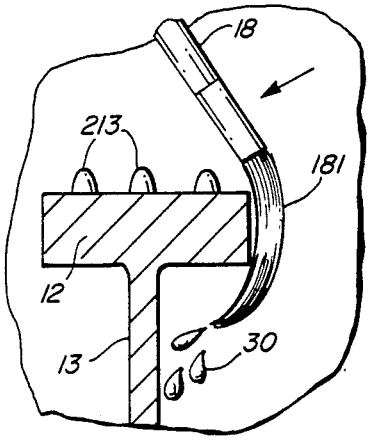
FIGS. 4–7 illustrate various stages in the inertial removal of liquid from the bristles of a brush as the bristles are caused to change abruptly their speed of movement in the course of being intercepted and released from contact by the splatter bar of the brushing cleaning apparatus.

In FIG. 4, the brush 18 is moved in the direction indicated by the arrow. Bristles 181 of brush 18 are intercepted in their path of movement by splatter bar 12. Reference 13 refers to the base support of splatter bar 12 if such support is required. When bristles 181 are intercepted by splatter bar 12, the bristles 181 tend to curl to the left, as illustrated, and are abruptly brought to an instantaneous stop causing particles of fluid to be carried by their own inertia away from the bristles 181.

Figure 5:
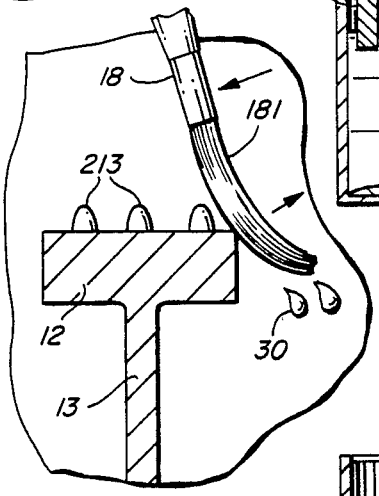
Figure 6:
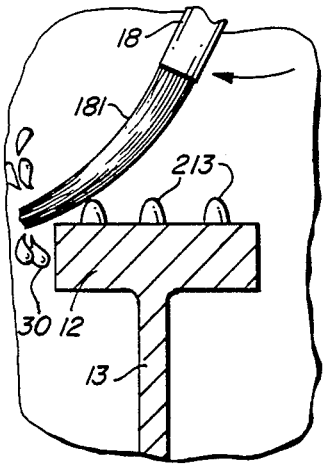
Figure 7:
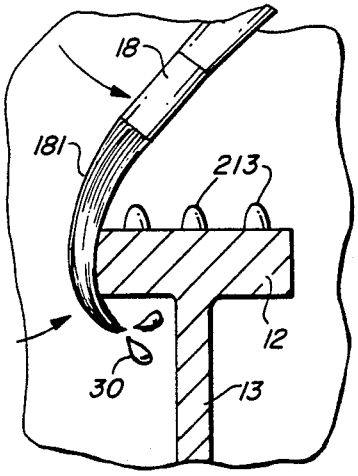

As the movement of brush 18 is continued in the direction of the arrow as indicated in FIG. 5, the bristles 181 experience a rapid change in direction toward the right as illustrated which movement is rapidly decelerated as the bristles 181 are drawn across thetop of splatter bar 12. In the course of this rapid deceleration, additional fluid particles 30 are dispersed by their inertia from bristles 181. As the brush 18 continues it motion, bristles 181 are dragged across the top of splatter bar 12 until they are released from contact with the splatter bar 12 wherein they experience another increase in acceleration due to the natural resiliency of the bristles 181. This rapid acceleration is followed immediately by a rapid deceleration as the bristles 181 assume their natural shape and again fluid particles 30 are dispersed from the bristles. FIG. 6. The sequence of FIGS. 4 through 6 illustrate how a unidirectional single brush motion across splatter bar 12 produces a series of abrupt reversals of inertial forces upon bristles 181.

The motion of brush 18 is then reversed, as indicated in FIG. 7, so as to again bring the bristles 181 into a path to be intercepted by splatter bar 12 and the process is repeated.

Raised elements, or nubbins, 213 may be provided at the top surface of splatter bar 12 to separate the bristles 181 as they pass across the surface of splatter bar 12 and lessen their ability to retain fluid. This action is illustrated in FIG. 8.

When an artist is painting with a brush loaded with a particular color and he wishes to use the same brush but change the color with which the brush is loaded, he will first wash the brush to remove most of the color therefrom and then subject the brush to the inertial cleaning operation just described wherein the path of the moving brush is such that the brush bristles are intercepted by a splatter bar and the fluid carried by the bristles is dispersed inertially from the brush bristles and into a collection container provided by splatter container 11. In FIG. 9 is illustrated a container 15 which is provided with a hook handle 151 to permit container 15 to be coupled to the side of splatter container 11 as illustrated in FIG. 3. Container 15 is utilized as a liquid thinner containing vessel in the illustration of FIG. 9. Here, float 21 is floated on liquid thinner 22. Float 21 tends to diminish the surface area of thinner 22 thus decreases the rate of surface evaporation of thinner 22. Float 21 is provided with orifices 212 to permit the easy passage of thinner 22 therethrough as float 22 is depressed beneath the surface of thinner 22 and allowed to again rise to the surface thereof. Raised elements, or nubbins, 213 are provided on the surface of float 21 as an aid in separating the bristles of a brush brought in contact therewith so as to enhance the washing of brush bristles within thinner 22. Sludge 23 arising from the washing of brushes within thinner 22 will settle to the bottom of container 15.

Figure 10:
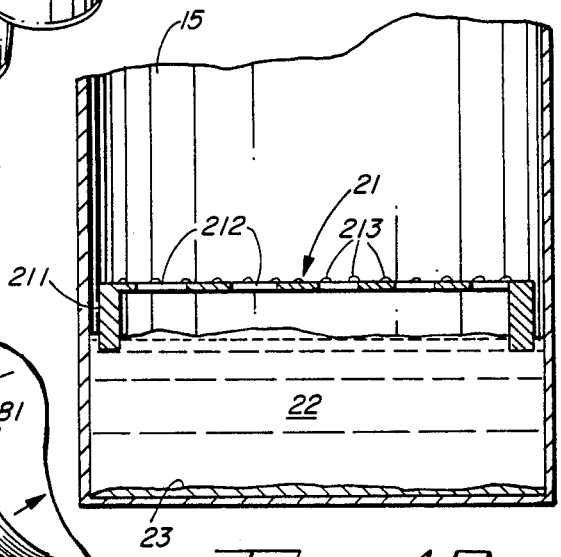
FIG. 10 is a cross-sectional view of the liquid thinner containing vessel of FIG. 9 showing the float means with the orifices in the surface through which the liquid thinner may flow as the float means is depressed for purposes of washing a brush therein.

FIG. 10 illustrates the manner in which float 21 rises to the surface of thinner 22. Reference 211 is to the wall of float 21.

Figure 11:
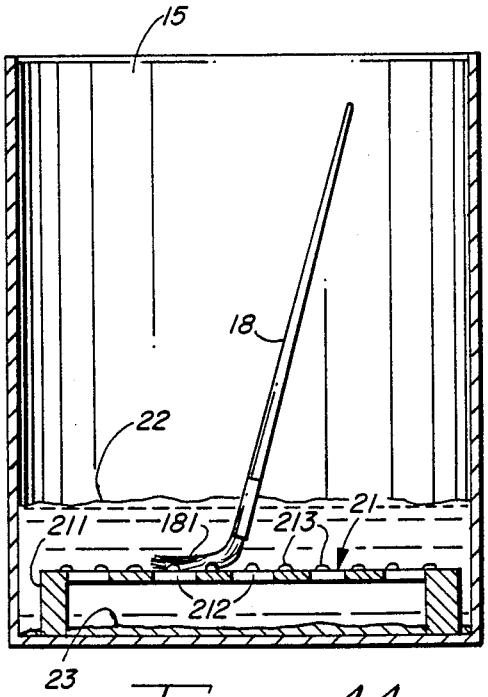
FIG. 11 is again a cross-sectional view of the liquid thinner containing vessel showing a paintbrush impinging upon the surface of the float so as to submerge it below the surface of the liquid thinner for purposes of washing the brush.

FIG. 11 illustrates a brush being washed within container 15 having therein liquid thinner 22 and float 21. Thinner 22 may be water, turpentine, or the like depending upon the painting medium being employed by the artist. When the bristles 181 of brush 18 are brought into contact with float 21, float 21 sinks below the surface of thinner 22. The brush is moved so as to cause the bristles 181 to traverse the surface of float 21 wherein the raised nubbins 213 aid in separating the bristles 181 and enhance the washing action of thinner 22 on bristles 181. Sludge 23, resulting from the cleaning action of bristles 181, is carried down through openings 212 of float 21 to settle to the bottom of container 15. Any sludge which may have a tendency to remain on the surface of float 21 is urged downward through openings 212 as float 21 rises up toward the surface of thinner 22 when brush 18 is removed from container 15.

What has been described are the means and method for inertially removing fluid from the bristles of brush by causing the bristles of a moving brush to be intercepted in the path of their motion in a manner so as to abruptly affect the speed of movement of the bristles and so inertially disperse fluid therefrom. The fluid so dispersed is collected within an opened top container comprising an upright walled enclosure. This upright walled enclosure may be utilized in the manner disclosed as means for stowing and transporting additional items useful to an artist.

Those skilled in the art will readily conceive of other embodiments of the invention which may be drawn from the teachings herein. To the extent that such other embodiments are so drawn it is intended that they fall within the gamut of protection protection provided by the claims appended hereto.

Having described my invention in the foregoing specification and the accompanying drawings in such a clear and concise manner that those skilled in the art will be readily able to understand and practice the invention, that which I claim is:

1. Brush cleaning apparatus comprising in combination:

means for inertially removing fluid from the bristles of a brush, comprising means for intercepting the path of the bristles of a moving brush so as to abruptly affect the speed of movement of the bristles to inertially disperse fluid therefrom by a series of abrupt reversals of inertial forces;

collection means coupled to a said means for inertially removing fluid from the bristles of a brush for collecting fluid so removed, said collection means comprising an open top container comprised of an upright walled enclosure;

wherein said means for intercepting the path of the bristles of a moving brush comprises splatter bar means coupled across a pair of walls of said upright walled enclosure and separated on either side from the other walls of said walled enclosure by spaces through which the brush may be moved to cause the bristles to intercept said splatter bar and experience an abrupt reversal of the inertial forces acting on the moving brush;

a liquid thinner containing vessel for washing the bristles of a brush;

float means for floating on the liquid thinner contained within said vessel, said float means being disposed to sink within said liquid thinner when the bristles of a brush are drawn into contact with said float means;

said float means further comprising a surface bearing a plurality of orifices through which said liquid thinner may flow as seen float means is submerged when in contact with the bristles of a brush and as said float means rises to the surface of said liquid when the bristles of a brush are removed from contacting said float means; and said surface further comprising a plurality of vertically disposed raised elements for separating the bristles of a brush brought into contact with said float means.

2. The brush cleaning apparatus of claim 1 further comprising splatter shield means interposed between the opened top of said container and said splatter bar means.

3. The brush cleaning apparatus of claim 1 further comprising container means removably stowable for transport within said collection means.

4. The brush cleaning apparatus of claim 3 further comprising tray means removably stowable for transport within said collection means.

5. The brush cleaning apparatus of claim 4 further comprising removable cover means for closing said opened top container.

* * * * *